US005657497A

United States Patent [19]

Howe

[11] Patent Number: 5,657,497

[45] Date of Patent: Aug. 19, 1997

[54] SLEEPING BAG WITH OVERLAPPING BATTS

[76] Inventor: Robert H. Howe, 4285 Whittle Ave., Oakland, Calif. 94602

[21] Appl. No.: 539,331

[22] Filed: Oct. 4, 1995

[51] Int. Cl.[6] ..... A47C 29/00

[52] U.S. Cl. ..... 5/413 R; 5/486; 2/69; 2/69.5; 2/243.1

[58] Field of Search ..... 2/69.5, 69, 243.1, 2/167, 2.5, 93, 94, 97, 79, 80; 5/413 R, 486, 500, 501, 502

[56] References Cited

U.S. PATENT DOCUMENTS

| | | | |
|---|---|---|---|
| 1,393,975 | 10/1921 | Rowley . | |
| 1,465,767 | 8/1923 | Krause . | |
| 1,513,766 | 11/1924 | Spooner | 5/502 |
| 2,350,363 | 6/1944 | Massa | 5/502 |
| 3,878,574 | 4/1975 | Erickson | 5/343 |
| 4,090,269 | 5/1978 | Hunt | 5/343 |
| 4,354,281 | 10/1982 | Satoh | 2/69.5 |
| 4,748,703 | 6/1988 | Emi et al. | 5/502 |
| 4,884,303 | 12/1989 | Scherer | 5/413 |
| 4,894,878 | 1/1990 | Roach | 5/413 |
| 5,110,383 | 5/1992 | Kramer | 156/88 |
| 5,146,634 | 9/1992 | Hunt | 5/502 |
| 5,408,712 | 4/1995 | Brun | 5/502 |

*Primary Examiner*—Flemming Saether
*Assistant Examiner*—Tuyet-Phuong Pham
*Attorney, Agent, or Firm*—David Pressman

[57] ABSTRACT

A sleeping bag includes batts (17, 18) transversely positioned in a shingle arrangement between outer and inner shells (10, 23). The sleeping bag includes a top flap and a bottom flap (11, 12). The batts in the bottom flap are straight, and overlap enough to provide two layers of insulation. A group of batts (17) in the top flap are curved toward the head end of the sleeping bag, and the remaining batts (18) in the top flap are curved toward the foot end. The batts that are curved in the same direction overlap enough to provide two layers of insulation. Some of the batts that are curved in opposite directions are close enough to overlap in three layers in the upper torso area to provide greater insulation where it is most needed. The curved batts provide a more efficient distribution of insulation, without increasing material weight or manufacturing cost.

15 Claims, 6 Drawing Sheets

SLEEPING BAG WITH OVERLAPPING BATTS

BACKGROUND OF THE INVENTION

1. Field of the Invention

This invention relates generally to insulated coverings, specifically to a sleeping bag with batts that more effectively and economically provide increased insulation in a needed area.

2. Prior Art

A typical sleeping bag is constructed by sewing separate batts, or wide strips of insulation, one at a time onto a shell along straight quilt lines. Successive batts overlap preceding ones by half their width, so as to form two layers of insulation in a "shingle" arrangement. The distribution of the insulation is substantially even throughout the sleeping bag, i.e., it is two layers thick all around. However, an even distribution is inefficient, because a person's upper torso, which is the most critical area to keep warm, is not insulated any more than the lower torso or the legs. Increasing upper torso insulation by increasing the insulation of the entire bag is also inefficient, because the lower parts would be overly insulated, thus adding unnecessary weight and cost.

U.S. Pat. No. 4,090,269 to Hunt (1978) and 4,354,281 to Satoh (1982) show sleeping bags with parallel batts arranged transversely between inner and outer shells. The batts are evenly overlapped to provide two layers of insulation at all points on the sleeping bag. However, as stated, an even distribution of insulation is inefficient. Furthermore, two layers of insulation may not be enough for very cold climates.

U.S. patent to Roach (1990) shows a sleeping bag with parallel batts arranged longitudinally between inner and outer shells. The batts are overlapped to provide two layers of insulation at all points on the sleeping bag. However, again the even distribution of insulation is inefficient, and may not be enough for harsher climates.

It is also known that half batts, i.e., batts half the width of conventional batts, can be added to the upper torso area at intervals to provide more insulation. However, this is difficult and expensive to implement in production, because a worker must handle several different bulky batts simultaneously, and must remember the precise installation intervals of the full-width and half-width batts.

Insulated coverings similar to those proposed for sleeping bags have also been proposed for other garments. U.S. Pat. No. 1,393,975 to Rowley (1921) shows a continuous sheet of insulation folded back on itself three times at regular intervals to form elongated strips of insulation three layers thick. Although it provides greater insulation than two-layered coverings, it is difficult to manufacture, because folding a large sheet of thick insulation back and forth a great number of times is difficult and time consuming.

OBJECTS OF THE INVENTION

Accordingly the primary object of the present invention is to provide a sleeping bag with greater insulation in an upper torso or other desired area without increasing weight or manufacturing cost. Additional objects are to provide a more efficient sleeping bag, a sleeping bag that is easier and more economical to manufacture, and a sleeping bag that makes more efficient use of materials. Further objects of the present invention will become apparent from a consideration of the drawings and ensuing description.

SUMMARY OF THE INVENTION

A sleeping bag includes balls attached transversely in a shingle arrangement between inner and outer shells. The sleeping bag includes top and bottom flaps. The batts in the bottom flap are straight, and overlap in two layers. A contiguous group of batts in the top flap are curved toward the head end of the sleeping bag, and the remaining batts are curved toward the foot end. The batts that are curved in the same direction overlap in two layers. Some of the batts that are curved in opposite directions are close enough to overlap in three layers in the upper torso area to provide greater insulation.

Figure 1A:
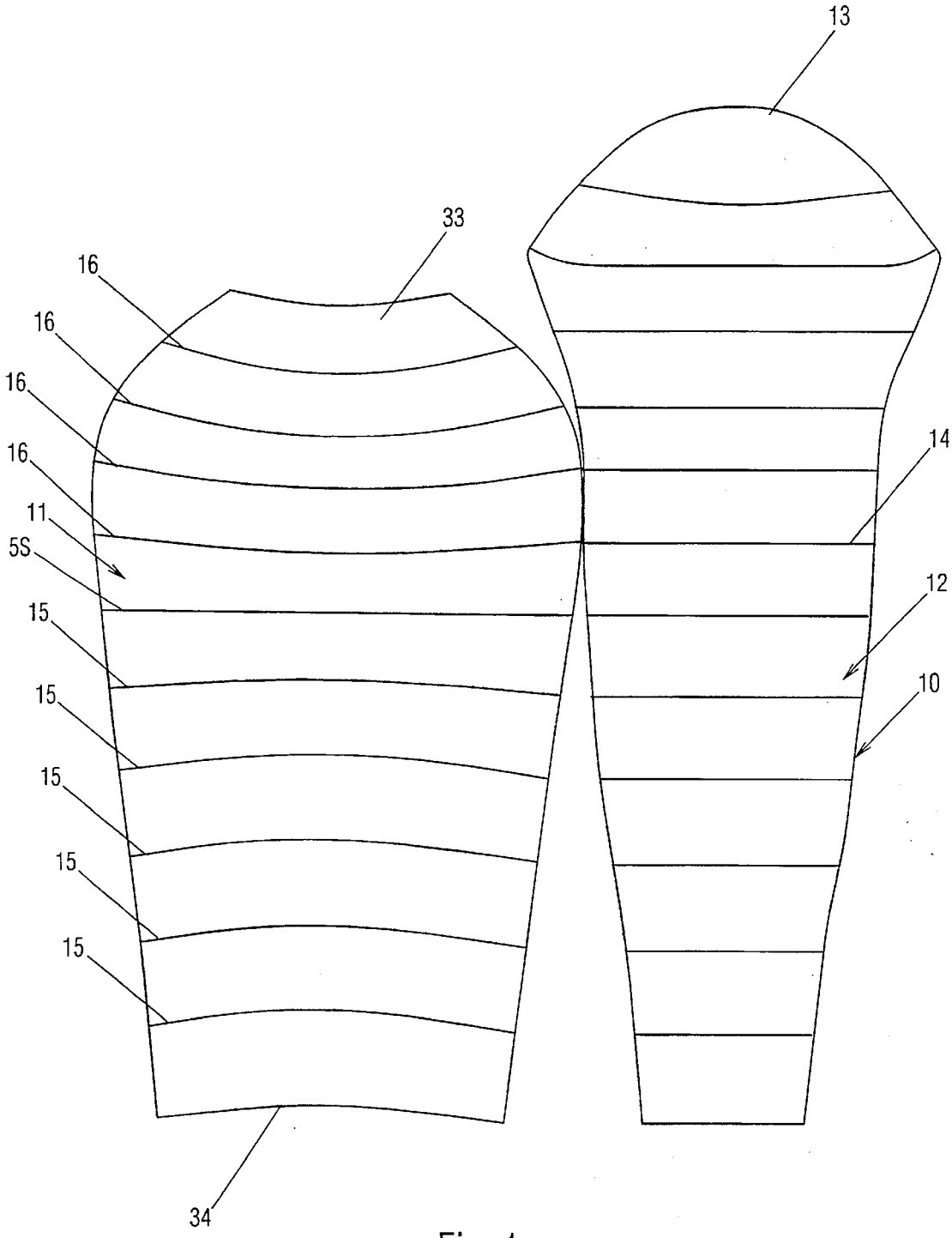
FIG. 1A is a top perspective view of an outer shell of a sleeping bag in accordance with a preferred embodiment of the invention.

| Drawing Reference Numerals | |
|---|---|
| 10. Outer Shell | 11. Top Flap |
| 12. Bottom Flap | 13. Head Rest |
| 14. Straight Quilt Lines | 15. Curved First Quilt Lines |
| 16. Curved Second Quilt Lines | 17. First Batts |
| 18. Second Batts | 19. Two Layers Of Insulation |
| 20. Three Layers Of Insulation | 21. Two Layers Of Insulation |
| 22. Head Opening | 23. Inner Shell |
| 24. Batt | 25. Batt |
| 26. Batt | 27. Batt |
| 28. Batt | 29. Batt |
| 30. Zipper | 33. Head End of Sleeping Bag |
| 34. Foot End Of Sleeping Bag | |

DESCRIPTION—FIG. 1—OUTER SHELL

Figure 1B:
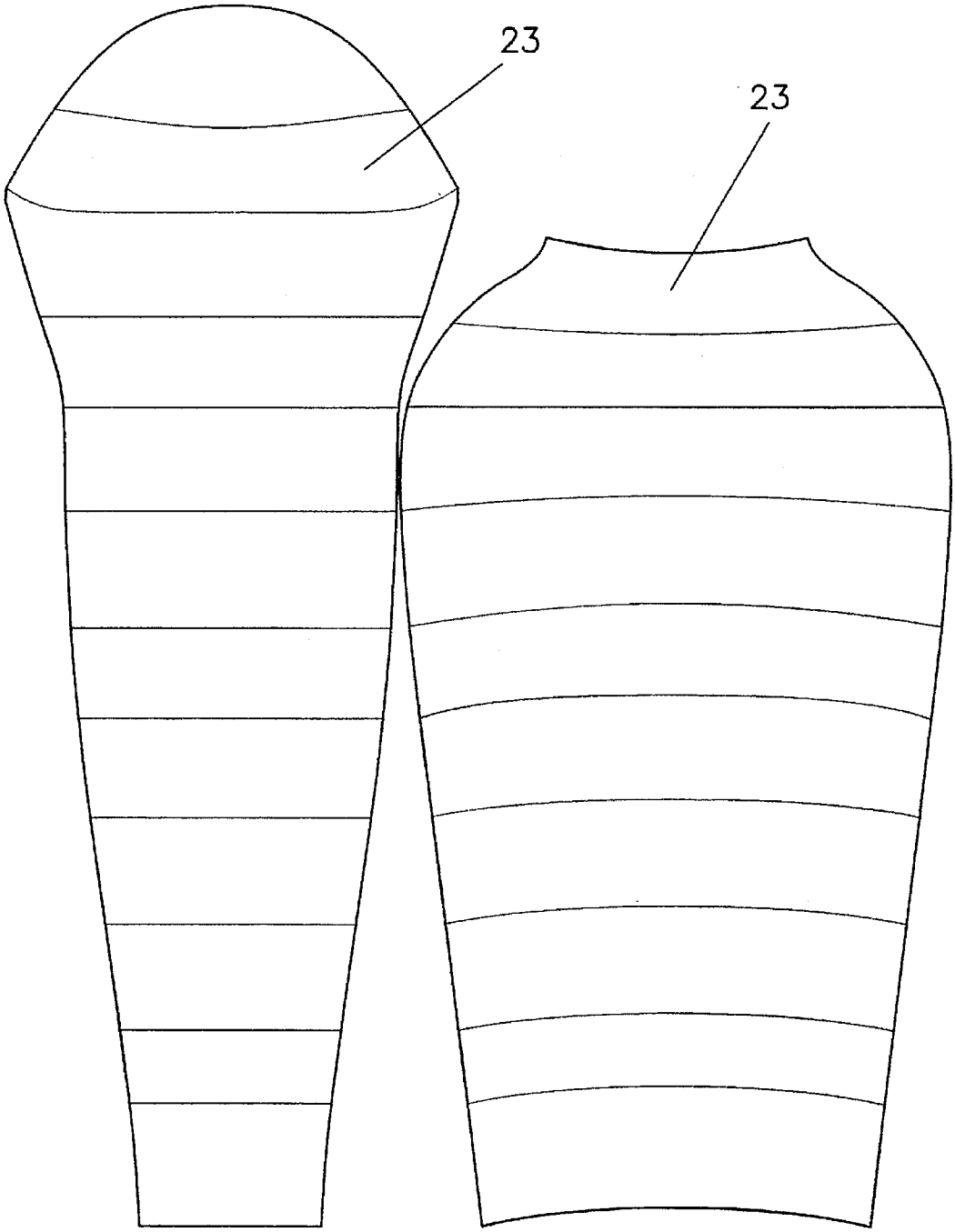
FIG. 1B is a top perspective view of an accompanying inner liner.

In accordance with a preferred embodiment of the invention shown in the top perspective views of FIGS. 1A and 1B, an insulated covering or sleeping bag is constructed by providing a fabric outer shell 10 (FIG. 1A) with elongated top and bottom outer sides or flaps 11 and 12, respectively, which are laid flat during assembly. Outer shell 10 is preferably made of nylon. Bottom flap 12 is longer than top flap 11 so as to provide a head rest 13. A set of straight quilt lines 14 are drawn transversely on bottom flap 12 at predetermined intervals. All lines and shapes are shown in their approximate true proportions for one model bag, although other proportions and sizes can be used. Preferably lines 14 are arranged about 11.25 cm to 18.5 cm apart, and are drawn in chalk using a frame of battens or rigid slats (not shown) to provide the necessary guide edges. First and second sets of curved quilt lines 15 and 16, respectively, are drawn transversely on top flap 11. First quilt lines 15 are curved toward (i.e., their convex sides face) a head end 33 of the sleeping bag, and second quilt lines 16 are curved toward a foot end 34, so that quilt lines 15 and 16 are curved toward each other. A straight line 158 is provided in the middle of the bag between lines 15 and 16, as shown. Preferably lines 15 and 16 are about 11.25 cm to 18.5 cm apart, and are curved so that each middle point or apogee is 2.5 cm to 7 cm from an imaginary line connecting each line's ends. FIG. 1B shows the accompanying inner liner 23 for outer shell 10. The batts of insulation are placed between the outer shell and the inner liner.

DESCRIPTION—FIGS. 2 AND 3—BATTS INSTALLATION

Figure 2:
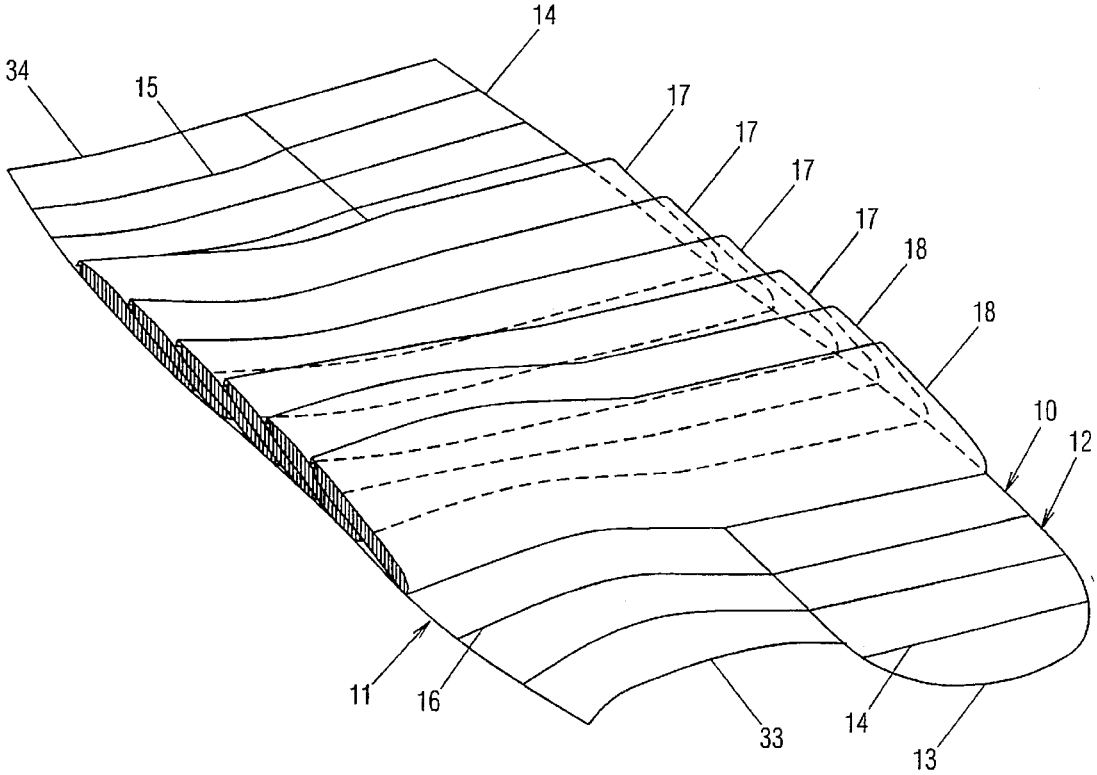
FIG. 2 is a top perspective view of the sleeping bag with batts sewn onto the outer shell.

The sleeping bag is shown in an initial stage of assembly in the top perspective view in FIG. 2. The side edges of a first or bottom set of flexible, insulating sheets or batts 17 are sewn, one at a time, onto outer shell 10 along bottom quilt lines 14 and quilt lines 15 to form an overlapping or shingle arrangement. The portion of each batt 17 attached to bottom flap 12 is straight, and the portion attached to top flap 11 is bent to follow a corresponding curved quilt line 15.

A second or upper set of flexible batts 18 are also sewn onto outer shell 10 in a shingle arrangement, one at a time, along upper quilt lines 14 and quilt lines 16. The portion of each batt 18 attached to bottom flap 12 is straight, and the portion attached to top flap 11 is bent to follow a corresponding curved quilt line 16. Therefore, the curved portions of batts 17 and 18 are curved toward each other. The sleeping bag is shown partially fitted with batts; additional batts (not shown) will be sewn to the remaining quilt lines.

Batts 17 and 18 are each 117 cm to 175 cm long by 45 cm wide by 5 cm thick, and preferably made of polyester fiber.

Figure 3:
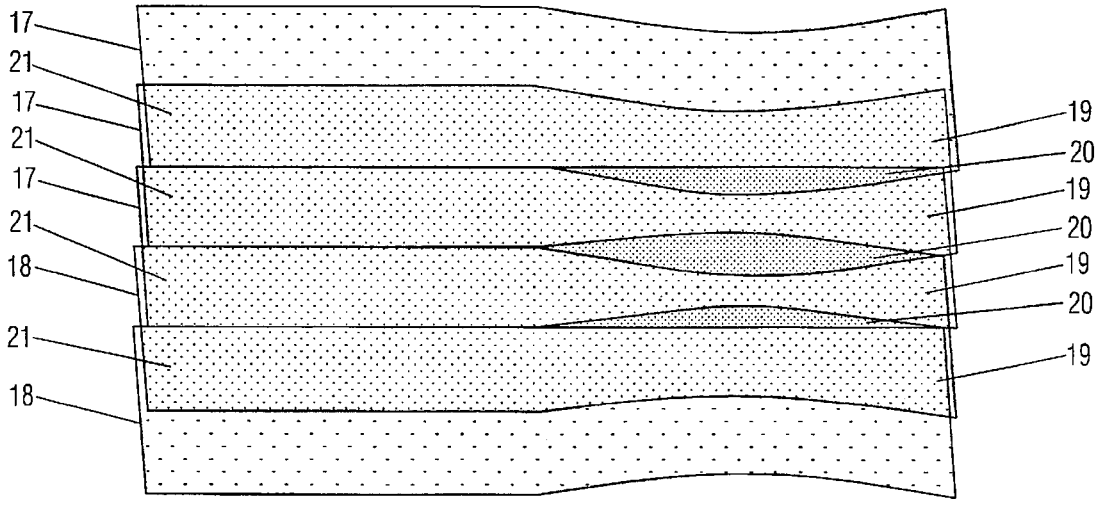
FIG. 3 is a top partial view oft he sleeping bag of FIG. 2.

FIG. 3 shows a top view of the portion of the sleeping bag where batts 17 and 18 meet. The balls that curve in the same direction overlap an adjacent batt by about half their width, so that they overlap in two layers at areas 19. Some batts that curve in opposite directions ire close enough to overlap in three layers at areas 20. The straight portions of batts 17 and 18 overlap in two layers at areas 21.

Additional batts 24 to 29 (FIG. 7) are attached in the head, shoulder, and foot areas as indicated to provide insulation in areas where the existing insulation provided by batts 17 and 18 is not doubled or tripled, or is absent but needed.

DESCRIPTION—FIG. 4—ASSEMBLED SLEEPING BAG

Figure 4:
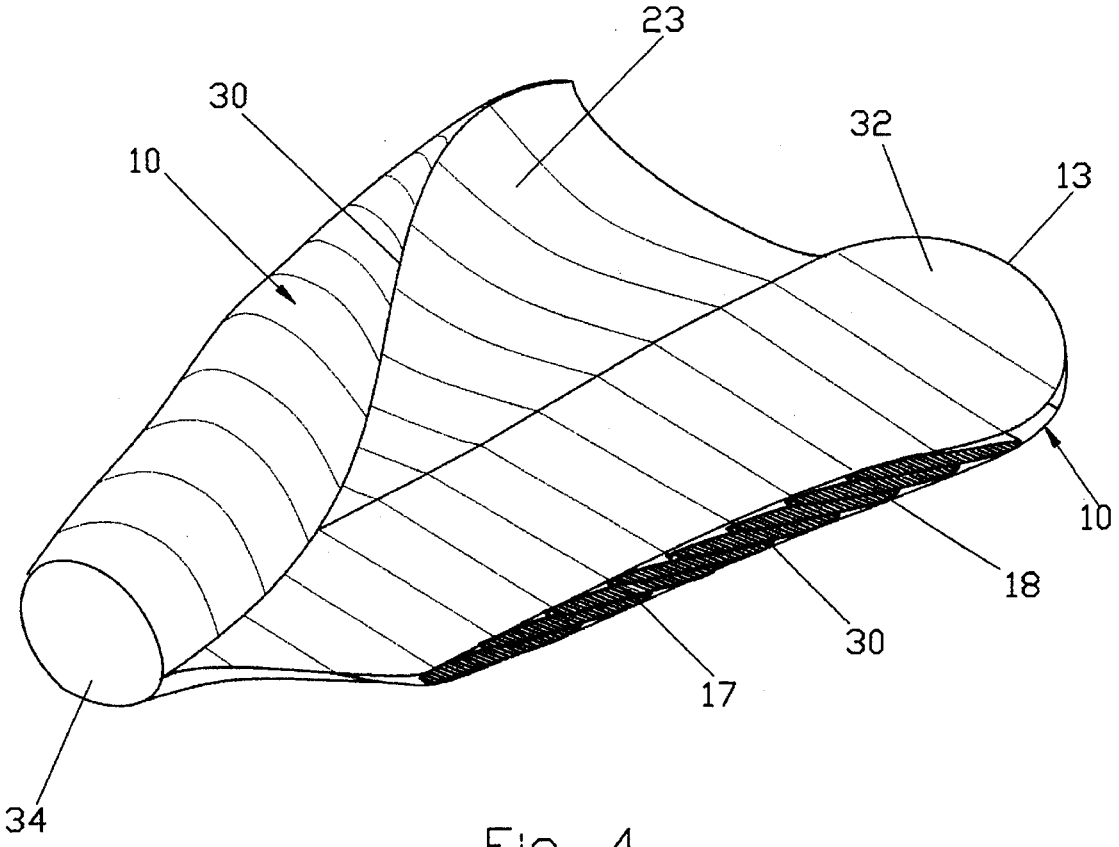
FIG. 4 is a top perspective view of the assembled sleeping bag.

As shown in FIG. 4, after all the batts are installed, inner liner 23 (FIG. 1B) coextensive with outer shell 10 is attached over batts 17 and 18, and a zipper 30 is installed along the edges of the shells. Inner shell 23 is preferably made of nylon. Inner shell 23 provides a top inner flap 31 (over top outer flap 11) and a bottom inner flap 32 (over bottom outer flap 12). Top inner flap 31, in conjunction with top outer flap 11 ,and the insulating batts therebetween, provides a top side of the sleeping bag that can be folded over the bottom of the bag (bottom inner flap 32, bottom outer flap, 12, and the insulation therebetween) for covering a person lying therebetween. In a conventional manner, the outer edges of the top and bottom are zippered together.

DESCRIPTION—FIGS. 5 TO 7—ASSEMBLED SLEEPING BAG

Figure 5:
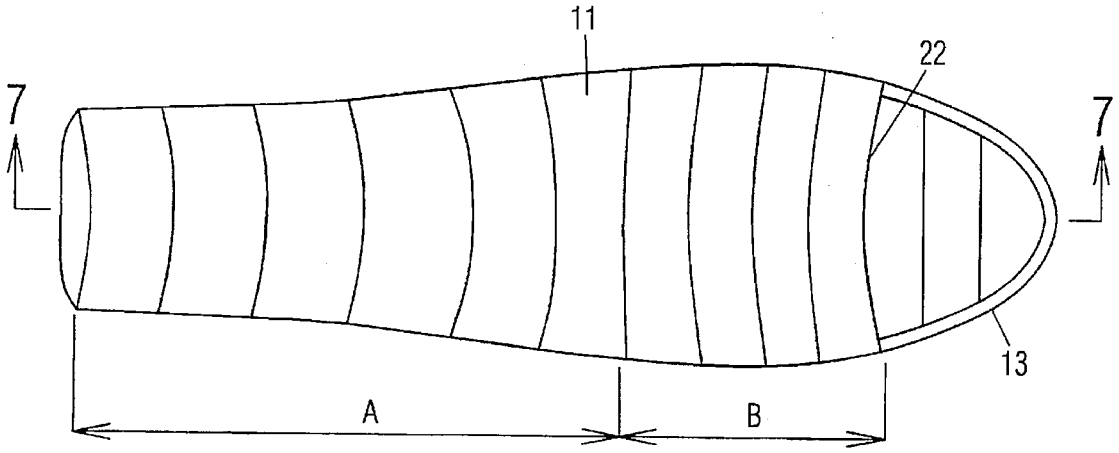
FIG. 5 is a top view of the folded sleeping bag.
Figure 6:
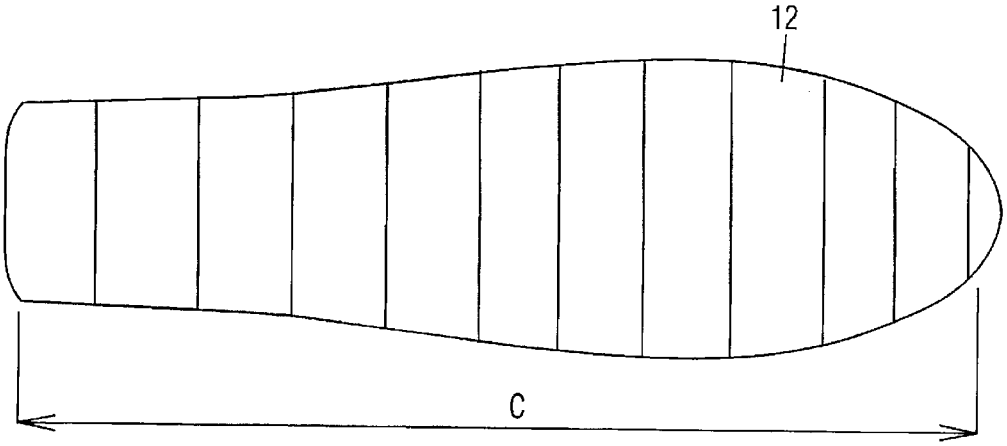
FIG. 6 is a bottom view of the folded sleeping bag.
Figure 7:
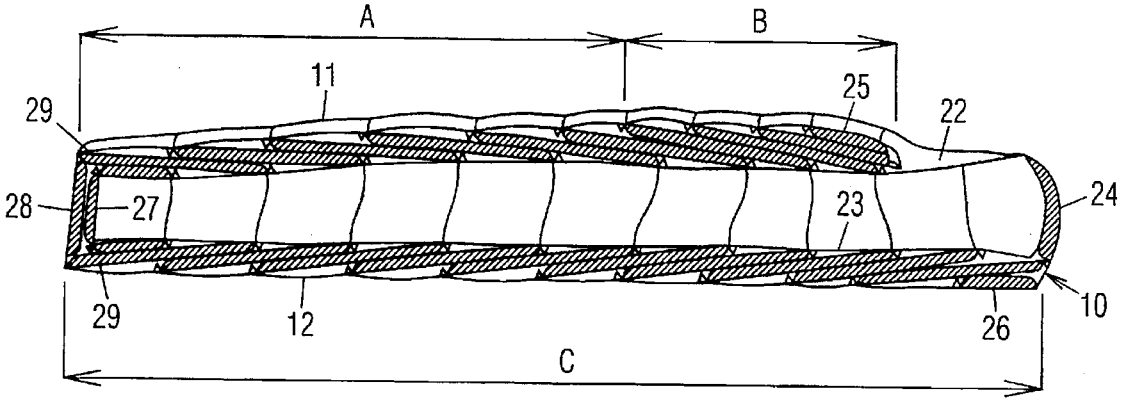
FIG. 7 is a side sectional view of the folded sleeping bag, taken along line 7—7 in FIG. 5.

A fully assembled and folded sleeping bag is shown in the top, bottom, and side sectional views in FIGS. 5, 6, and 7, respectively. A head opening 22 is formed adjacent head rest 13. Note additional batts 24 to 29 between shells 10 and 23 in areas not covered adequately by batts 17 and 18 to provide good insulation all around the sleeping bag.

Top flap 11 can be considered as having two areas A and B with two and three overlapping layers of insulation, respectively, and bottom flap 12 with an area C with two overlapping layers of insulation. Area B is positioned at the upper torso area for providing the greatest insulation where it is most needed. The size, shape, and number of batts 17 and 18 are conventional. The increased insulation in area B is provided solely by sewing the batts along two sets of oppositely curved quilt lines, instead of the straight quilt lines used in prior art sleeping bags. Therefore, a more efficient distribution of insulation in the sleeping bag is provided without increasing its material cost, weight, or assembly time.

SUMMARY, RAMIFICATIONS AND SCOPE

Accordingly, the reader will see that I have provided a sleeping bag with greater insulation in the upper torso area without increasing its weight or manufacturing cost. The extra insulation can be provided in a very simple manner which is not labor-intensive.

Although the above descriptions are specific, they should not be considered as limitations on the scope of the invention, but only as examples of the embodiments. Many other ramifications and variations are possible within the teachings of the invention. For example, four or more layers of insulation can be provided by curving the batts even more. In addition to sleeping bags, the insulated covering can be used for other applications, such as clothing. The top and bottom flaps of the sleeping bag can be made separately and attached together. The batts on the bottom flap can also be curved to provide an uneven distribution of insulation. The sizes, shapes, and materials of all components can be varied. The batts can be glued or riveted in place, instead of being sewn. The extra insulation can be provided in areas other than the upper torso. The method or technique of the invention can be used for other insulated coverings, such as clothing for humans and non-human animals, structural insulation, appliance insulation, etc. The batts can be arranged longitudinally instead of transversely. Therefore, the reader is requested to determine the scope of the invention by the appended claims and their legal equivalents, and not by the examples given.

I claim:

1. A sleeping bag, comprising:

an elongated outer shell;

an elongated inner liner coextensive with said outer shell;

a plurality of first batts arranged transversely between said outer shell and said inner liner at a foot end of said sleeping bag in a shingle arrangement, said first batts being curved toward a head end of said sleeping bag; and a plurality of second batts arranged transversely between said outer shell and said inner liner at said head end of said sleeping bag in a shingle arrangement, said second batts being curved toward said foot end of said sleeping bag, so that said first and second batts are curved toward each other.

2. The sleeping bag of claim 1 wherein some of said second batts overlap some of said first batts to provide at least three layers of insulation within a predetermined area.

3. The sleeping bag of claim 2 wherein said area comprises an upper torso area of said sleeping bag.

4. The sleeping bag of claim 1, further including a zipper attached along an edge of said shells.

5. The sleeping bag of claim 1 wherein said batts overlap in two layers within a predetermined area, and in at least three layers within another predetermined area.

6. A sleeping bag, comprising:

an elongated outer shell;

an elongated inner liner coextensive with said outer shell, said outer shell and said inner liner being foldable together into top and bottom flaps;

a plurality of first batts arranged transversely between said outer shell and said inner liner at a foot end of said sleeping bag in a shingle arrangement, said fast batts including a curved portion positioned within said top flap and curved toward a head end of said sleeping bag, said first batts including a straight portion positioned within said bottom flap; and a plurality of second batts arranged transversely between said outer shell and said inner liner at said head end of said sleeping bag in a shingle arrangement, said second batts including a curved portion positioned within said top flap and curved toward said foot end of said sleeping bag, said second batts including a straight portion positioned within said bottom flap.

7. The sleeping bag of claim 6 wherein some of said second batts overlap some of said first batts to provide at least three layers of insulation within a predetermined area.

8. The sleeping bag of claim 7 wherein said area comprises an upper torso area of said sleeping bag.

9. The sleeping bag of claim 6, further including a zipper attached along an edge of said shells.

10. The sleeping bag of claim 6 wherein said batts overlap in two layers within a predetermined area, and in at least three layers within another predetermined area.

11. An insulated covering, comprising:

an outer shell;

an inner liner coextensive with said outer shell; and a plurality of separate batts positioned in a generally parallel manner between said outer shell and said inner liner, each batt partially overlapping an adjacent batt in a shingle arrangement, so that side edges of adjacent batts are spaced apart, and said batts overlap in two layers within a predetermined area, and in at least three layers within another predetermined area;

said plurality of separate batts comprising a plurality of first batts curved in one direction and a plurality of second batts curved in an opposite direction, said plurality of first batts and said plurality of second batts being curved toward each other.

12. The insulated covering of claim 11 wherein said plurality of first batts are arranged transversely between said outer shell and said inner liner at a foot end of said sleeping bag in a shingle arrangement, said plurality of first batts being curved toward a head end of said sleeping bag, and said plurality of second batts are arranged transversely between said outer shell and said inner liner at said head end of said sleeping bag in a shingle arrangement, said plurality of second batts being curved toward said foot end of said sleeping bag, so that said plurality of first batts and said plurality of second batts are curved toward each other.

13. The insulated covering of claim 11 wherein said outer shell and said inner liner are shaped to form a sleeping bag.

14. The insulated covering of claim 11 wherein said outer shell and said inner liner are elongated, and said batts are arranged transversely within said outer shell and said inner liner.

15. The insulated covering of claim 11 wherein said outer shell and said inner liner are made of a relatively thin material, and said batts are made of a relatively thick insulating material.

* * * * *

UNITED STATES PATENT AND TRADEMARK OFFICE

CERTIFICATE OF CORRECTION

PATENT NO.: 5,657,497
DATED: AUG 19, 1997
PATENTEE: ROBERT H. HOWE

I t is certified that error appears in the above-identified patent and that said Letters Patent is hereby corrected as shown below:

Col. 3, l. 32, change "ire" to —are—.
Col. 5, l. 6, change "fast" to —first—.

Signed and Sealed this
Fourteenth Day of October, 1997

*Attest:*

*Attesting Officer*

Bruce Lehman

BRUCE LEHMAN

*Commissioner of Patents and Trademarks*